US006352129B1

(12) United States Patent
Best

(10) Patent No.: US 6,352,129 B1
(45) Date of Patent: Mar. 5, 2002

(54) DRILLING SYSTEM

(75) Inventor: Bruno Best, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/599,753

(22) Filed: Jun. 22, 2000

(30) Foreign Application Priority Data

Jun. 22, 1999 (EP) ..... 99304885

(51) Int. Cl.[7] ..... E21B 17/02; E21B 17/18

(52) U.S. Cl. ..... 175/25; 175/217

(58) Field of Search ..... 175/25, 48, 65, 175/69, 71, 162, 206, 209, 212, 217; 73/355; 166/384, 385, 379, 380, 77.2

(56) References Cited

U.S. PATENT DOCUMENTS

| | | | | |
|---|---|---|---|---|
| 3,559,739 A | | 2/1971 | Hutchison | |
| 3,868,832 A | * | 3/1975 | Biffle | 64/23.5 |
| 4,315,553 A | | 2/1982 | Stallings | |
| 4,709,900 A | | 12/1987 | Dyhr | |
| 4,924,949 A | * | 5/1990 | Curlett | 175/25 |
| 5,048,620 A | | 9/1991 | Maher | |
| 5,348,107 A | * | 9/1994 | Bailey et al. | 175/162 |
| 5,638,904 A | * | 6/1997 | Misselbrook et al. | 166/384 |

FOREIGN PATENT DOCUMENTS

| | | |
|---|---|---|
| EP | 0 289 673 A1 | 11/1988 |
| WO | WO 98/16716 | 4/1998 |

* cited by examiner

*Primary Examiner*—Robert E. Pezzuto

(57) ABSTRACT

A drilling system for drilling a borehole into an earth formation is provided. The drilling system comprises a drill string extending into the borehole whereby an annular space is formed between the drill string and the borehole wall and the annular space contains a body of fluid. The drill string includes a longitudinal fluid passage having an outlet opening at the lower end part of the drill string, a device for selectively pumping drilling fluid via the passage and outlet opening into the body of fluid, and a fluid discharge conduit for discharging fluid from the body of fluid. The drilling system further comprises a device for controlling the fluid pressure in the body of fluid when the pumping device is inoperative to pump drilling fluid into the body of fluid.

10 Claims, 2 Drawing Sheets

DRILLING SYSTEM

FIELD OF THE INVENTION

The present invention relates to a drilling system for drilling a borehole into an earth formation.

BACKGROUND OF THE INVENTION

In the typical drilling system, an annular space is formed between the drill string extending into the borehole and the borehole wall. This annular space usually contains a body of drilling fluid. One of the purposes of the fluid in the annular space is to control the pressure at the wellbore wall, which pressure normally is kept between an allowable upper limit depending on the fracturing pressure of the rock formation and an allowable lower limit depending on the pore pressure of the formation fluid. The fluid pressure in the annular space is determined by the hydrostatic weight of the fluid column in the annular space, and by a dynamic pressure component which depends on the flow resistance of the drilling fluid in the annular space as the drilling fluid flows from the borehole bottom back to surface. The pressure is normally controlled by applying selected weighting material in the drilling fluid.

In the prior art it has been practiced to drill wellbores at wellbore pressures close to the lower limit, with the advantage that the risk of damage to the rock formation is reduced. Such applications are referred to as at-or under-balanced drilling whereby lighter drilling fluids than normal are applied. During tripping of the drill string out of the borehole or lowering the drill string into the borehole, the individual drill string sections are disconnected from each other so that no longer fluid can be pumped via the drill string into the annular space. During such tripping or lowering of the drill string, a problem arises in that the dynamic pressure component vanishes since no longer drilling fluid flows from the borehole bottom to surface. As a result the fluid pressure in the annular space can become lower than the allowable lower limit, potentially leading to undesired fluid influx from the earth formation into the borehole.

It is an object of the invention to alleviate the problem of the prior art and to provide a drilling system which can be safely used without the danger of undesired fluid influx from the earth formation into the borehole, even for at-and under-balanced drilling.

SUMMARY OF THE INVENTION

In accordance with the invention there is provided a drilling system for drilling a borehole into an earth formation, the drilling system comprising

- a drill string extending into the borehole whereby an annular space is formed between the drill string and the borehole wall, the annular space containing a body of fluid, the drill string including a longitudinal fluid passage having an outlet opening at the lower end part of the drill string;
- pumping means for selectively pumping drilling fluid via said passage and outlet opening into the body of fluid; and
- a fluid discharge conduit for discharging fluid from the body of fluid; wherein the drilling system further comprises pressure control means for controlling the fluid pressure in the body of fluid when the pumping means is inoperative to pump drilling fluid into the body of fluid.

DETAILED DESCRIPTION

Figure 1:
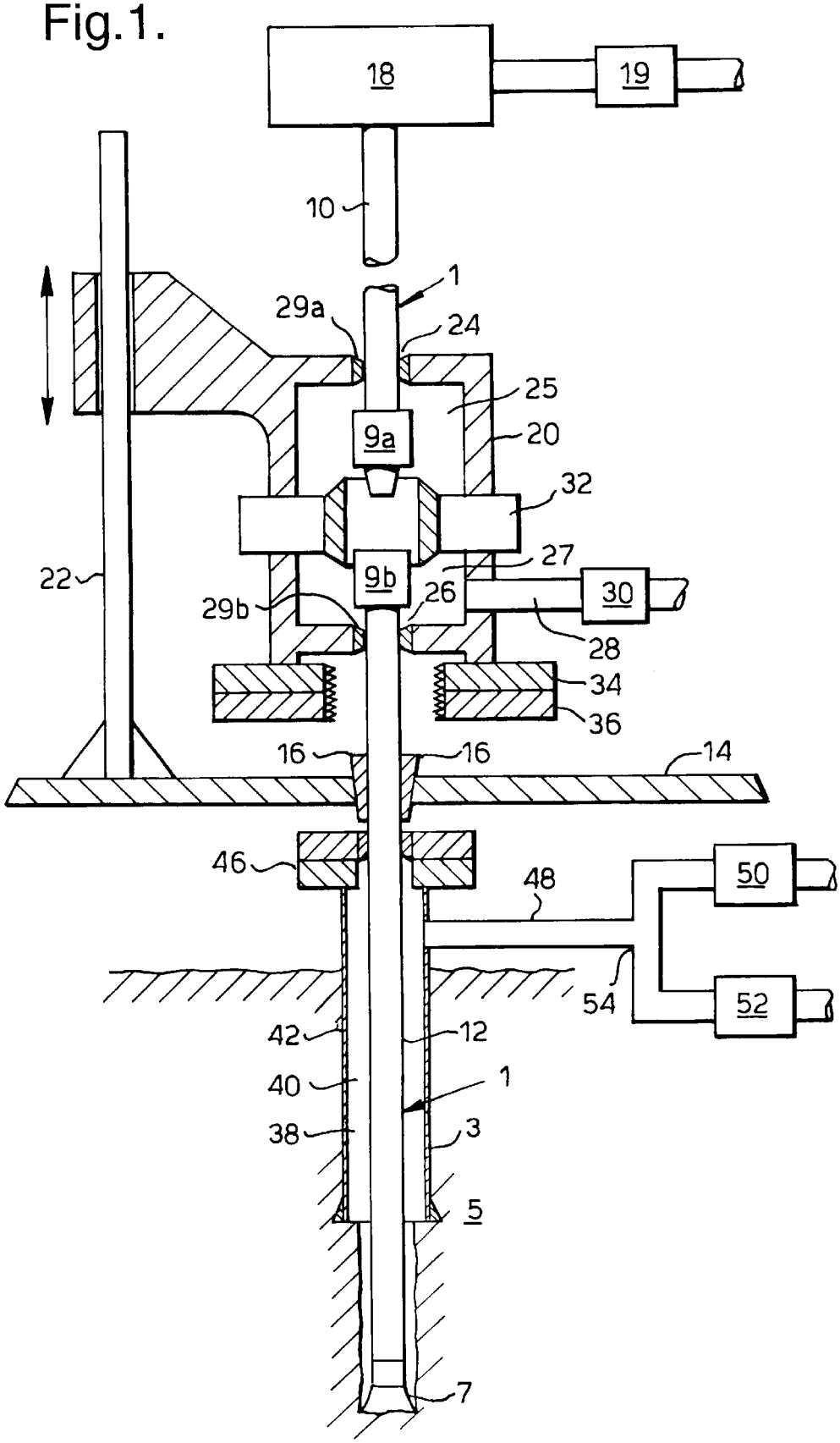
FIG. 1 schematically shows a first embodiment of the drilling system according to the invention.

By operating the fluid pressure control means when the pumping means is inoperable, for example during tripping or running of the drill string, it is achieved that the fluid pressure in the annular space can be increased to above the allowable lower pressure limit.

Suitably the pressure control means comprises a pump having a fluid outlet in fluid communication with the body of fluid. The pump can be a positive displacement pump such as a Moineau type pump, or a non-positive displacement pump such as a centrifugal pump or pump which injects fluid into the discharge conduit in upstream direction.

Preferably the pump is provided with pump control means for controlling the pump rate of the pump.

The invention will now be described in more detail and by way of example with reference to the accompanying drawings. In the Figures like reference numerals relate to like components.

In FIG. 1 is shown a drill string 1 extending into a borehole 3 formed in an earth formation 5 and provided with a drill bit 7 and a bottom hole assembly (BHA, not shown). The drill string 1 is made up of a plurality of drill string joints, whereby each pair of adjacent joints is interconnected by a releasable connector. For the purpose of clarity only one of the uppermost connectors 9*a*, 9*b* which connects the uppermost joint to the remainder of the drill string 1, is shown (in disconnected mode). In the description hereinafter, the upper drill string joint is referred to as the upper drill string section 10 and the remainder of the drill string 1 is referred to as the lower drill string section 12. The lower drill string section 12 is supported at rig floor 14 of a drilling rig (not shown) by power slips 16. The upper drill string section 10 is supported by a top drive 18 which is capable of supporting the entire drill string 1 and which is provided with a drive system (not shown) for rotating the drill string 1 during drilling. A primary pump 19 is in fluid communication with the upper drill string section to pump drilling fluid through the drill string 1 when the connector 9*a*, 9*b* is in connected mode.

A fluid chamber 20 is supported by a support column 22 provided at rig floor 14 in a manner allowing the fluid chamber 20 to move up or down along the column 22, and means (not shown) are provided to control such movement. The upper drill string section 10 extends into the fluid chamber 20 through an upper opening 24 of the fluid chamber 20 so that the open lower end of the upper drill string section 10 is located in an upper portion 25 of the chamber 20. The lower drill string section 12 extends into the fluid chamber 20 through a lower opening 26 of the fluid chamber 20 so that the open upper end of the lower drill string section 12 is located in a lower portion 27 of the chamber 20. Both the upper opening 24 and the lower opening 26 are of a sufficiently large diameter to allow passage of the drill string connectors (which generally are of slightly larger diameter than the drill string sections) therethrough. Furthermore, the upper and lower openings 24, 26 are provided with seals 29*a*, 29*b* which are controllable so as to be moved radially inward and thereby to seal against the respective upper and lower drill string sections 10, 12. The lower portion 27 of the chamber 20 is provided with a fluid inlet 28 in fluid communication with a secondary pump 30 to pump drilling fluid through the lower drill string section 12 when the connector 9*a*, 9*b* is in disconnected mode.

The upper portion 25 and the lower portion 27 of the fluid chamber 20 are selectively sealed from each other by a partitioning means in the form of a valve 32. A control device (not shown) is provided to open or close the valve 32, whereby in its open position the valve 32 allows passage of the drill string 1 through the valve 32. Furthermore, in the open position of the valve 32, the upper portion 25 and the lower portion 27 of the fluid chamber 20 are in fluid communication with each other. A pair of power tongues 34, 36 for connecting and disconnecting the connector 9*a*, 9*b* is attached to the fluid chamber 20 at the lower side thereof.

An annular space 38 is defined between the lower drill string section 12 on one hand and the borehole wall 39 and a wellbore casing 42 on the other hand, which annular space is filled with a body of drilling fluid 40. The annular space 38 is at its upper end sealed by a rotating blowout preventer (BOP) 46 which allows rotation and vertical movement of the drill string 1. A drilling fluid discharge conduit 48 is provided at the upper end of the annular space 38, which drilling fluid discharge conduit 48 debouches into a drilling fluid reservoir (not shown) via a controllable outlet valve 50. A tertiary pump 52 is arranged in parallel with the valve 50, which pump 52 is in fluid communication with the outlet conduit 48 at a branch connection 54 located between the valve 50 and the rotating BOP 46. The pump 52 is operable so as to pump fluid from a drilling fluid reservoir (not shown) into the annular space 38. The lower part of the drill string 1 is provided with means for controlling the flow of drilling fluid from the body of fluid 40 into the drill string 1 in the form of a non-return valve (non shown) which prevents such return flow.

During normal operation the drill string 1 is rotated by the top drive 18 to further drill the borehole 3 whereby the connector 9*a*, 9*b* is in connected mode. A stream of drilling fluid is pumped by primary pump 19 via the drill string 1 and the drill bit 7 into the annular space 38 where drill cuttings are entrained into the stream. The stream then flows in upward direction through the annular space and via the discharge conduit 48 and the valve 50 into the drilling fluid reservoir. The fluid pressure in the annular space 38 is controlled by controlling the pump rate of the pump 19 and/or by controlling the outlet valve 50.

When it is desired to remove the drill string from the borehole 3, the individual drill string joints are to be disconnected and removed from the drill string 1 in sequential order. This is done by disconnecting and removing the uppermost joint, moving the drill string 1 upwardly to a position wherein the joint which is now the uppermost joint can be removed, etc. To remove the uppermost joint (i.e. drill string section 10) the following procedure is followed. Rotation of the drill string 1 by the top drive 18 is stopped while drilling fluid is continuously circulated through the drill string by operation of primary pump 19. The fluid chamber 20 is moved along support column 22 to a position where the power tongues 34, 36 are located at the level of the connector 9*a*, 9*b*, whereupon the tongues 34, 36 are operated so as to break out and partly unscrew the connector 9*a*, 9*b*. The connector 9*a*, 9*b* is unscrewed by the slips only to the extent that further unscrewing can be done by the top drive 18. The fluid chamber 20 is then moved along support column 22 so as to position connector 9*a*, 9*b* inside the lower fluid chamber portion 27, and the seals 29*a*, 29*b* are moved radially inward so as to seal against the respective upper and lower drill string sections 10, 12. The secondary pump 30 is operated to pressurise fluid chamber 20. The top drive is then rotated in counter clockwise direction thereby further unscrewing the connector 9*a*, 9*b*. Once the connector 9*a*, 9*b* becomes disconnected the upper drill string section 10 is raised a short distance so as to position the upper connector half 9*a* in the upper portion 25 of the fluid chamber 20. The valve 32 is closed so as to seal the upper fluid chamber portion 25 from the lower fluid chamber portion 27. Simultaneously with closing the valve 32 the primary pump 19 is stopped and the secondary pump 30 is operated to pump drilling fluid through the fluid inlet 28 into the lower fluid chamber portion 27 and from there through lower drill string section 12 into the annular space 38. The seal 29*a* is retracted to remove the upper drill string section, and the drill string joint which has now become the uppermost joint is connected to the top drive 18. The procedure described heretofore is repeated in order to remove the now uppermost drill string joint. By the continued circulation of drilling fluid through the borehole 3 it is achieved that undesired settling of particles (e.g. drill cuttings) in the borehole occurs, and that the fluid pressure in the borehole can be controlled by controlling the pump rate of pump 30 and/or controlling the outlet valve 50.

Instead of using the secondary pump 30 to pump drilling fluid through the lower drill string section 12 when the connector 9*a*, 9*b* is disconnected, the primary pump 19 can be used for this purpose in which case the primary pump 19 is connected to the fluid inlet 28 by suitable conduit means.

The above procedure relies on the use of the fluid chamber 20 to control the fluid pressure in the borehole by continued fluid circulation through the drill string 1 when the upper drill string section 10 is disconnected. In case it is impractical or impossible to use the fluid chamber an alternative procedure can be applied to connect or disconnect the upper drill string section 10 to or from the drill string 1. In the alternative procedure, which can be applied in the absence of the fluid chamber, the tertiary pump 52 is operated so as to pump drilling fluid through the circuit formed by the pump 52, the branch connection 54, and the outlet valve 50. By controlling the pump rate of pump 52 and/or by controlling the outlet valve 50 the fluid pressure in the annular space can be controlled. The non-return valve in the drill string 1 prevents flow of drilling fluid from the annular space 38 into the drill string 1. The alternative procedure can be used, for example, in case drill string stabilisers prevent passage of the drill string through the fluid chamber.

An advantage of continued fluid circulation through the drill string 1 using the fluid chamber 20 when the upper drill string joint are disconnected, is that the fluid in the open part of the borehole 3 keeps flowing so that undesired settling of particles in the borehole is prevented. However once the drill string has been raised to a level whereby the drill bit 7 is located within the casing 42, the fluid which is pumped through the drill string 1 returns from the bit 7 through the annular space 38 to surface thereby leaving the fluid in the open part of the borehole 3 stationary. It is therefore preferred that, once the drill bit 7 is within the casing 42, pumping of fluid by secondary pump 30 is stopped and pumping by the tertiary pump 52 is commenced to control the fluid pressure in the borehole. This procedure has the advantage that the fluid chamber 20 then is no longer required and can be removed from the drill string.

Figure 2:
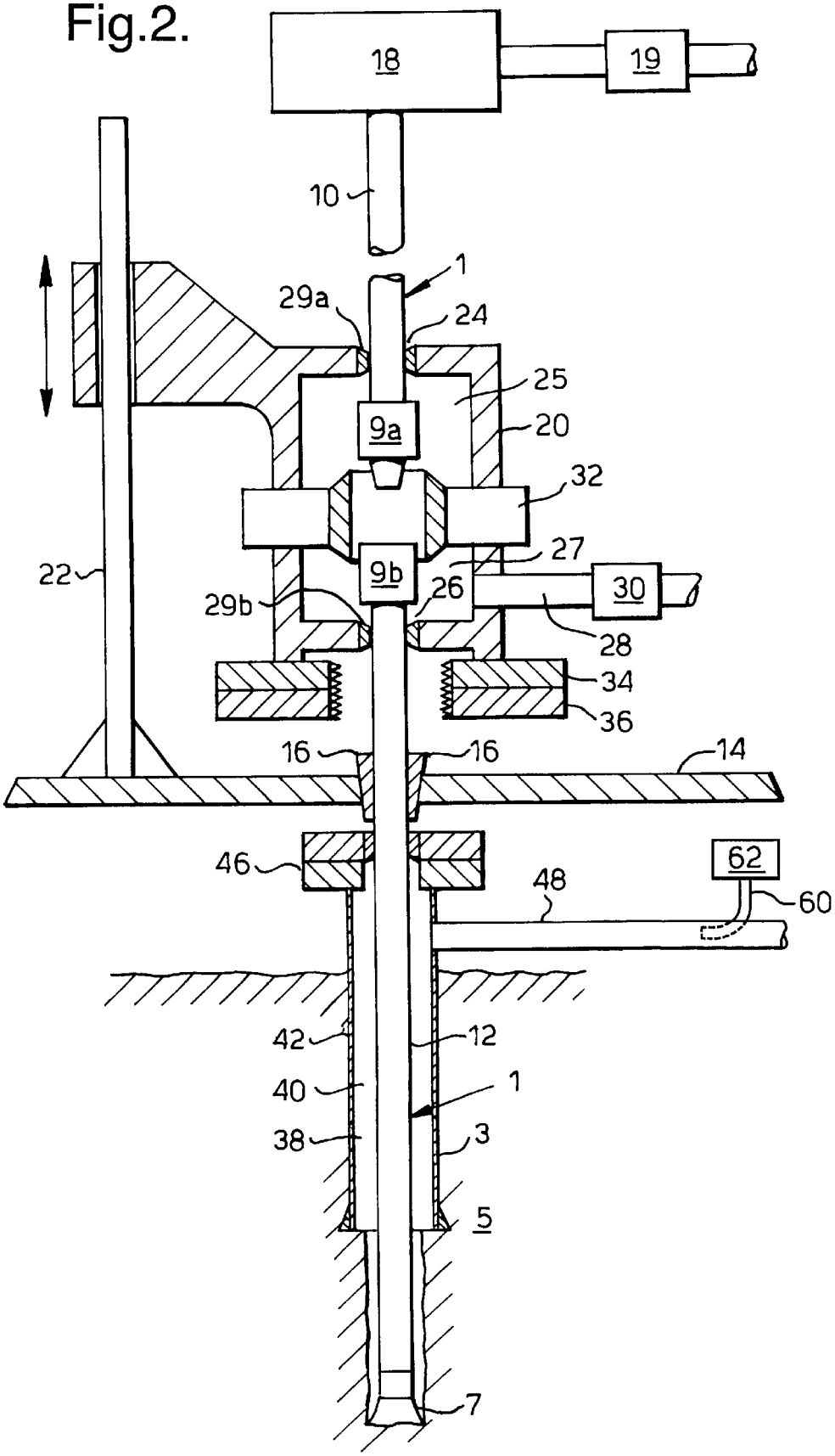
FIG. 2 schematically shows a second embodiment of the drilling system according to the invention.

The second embodiment shown in FIG. 2 differs from the first embodiment in that, instead of the valve 50/pump 52/branch connection 54 arrangement, the fluid discharge conduit 48 is provided with an injection nozzle 60 arranged to inject a stream of injection fluid into the fluid discharge conduit in a direction counter the normal direction of flow of drilling fluid through the discharge conduit. An injection pump 62 is arranged to pump injection fluid via the injection nozzle 60 into the fluid discharge conduit 48.

Normal operation of the second embodiment is similar to normal operation of the first embodiment, except that now the injection pump 62 is operated so as to inject gas or liquid at a controlled rate via the injection nozzle 60 into the fluid discharge conduit 48 in the direction counter the normal direction of flow of drilling fluid through the discharge conduit 48. As a result the flow resistance of drilling fluid in the fluid discharge conduit 48 is controlled, and consequently also the fluid pressure in the annular space 38.

I claim:

1. A drilling system for drilling a borehole into an earth formation, the drilling system comprising a drill string extending into the borehole whereby an annular space is formed between the drill string and the borehole wall, the annular space containing a body of fluid, the drill string including a longitudinal fluid passage having an outlet opening at the lower end part of the drill string;

pumping means for selectively pumping drilling fluid via said passage and outlet opening into the body of fluid, said pumping means in fluid communication with the passage; and a fluid discharge conduit in fluid communication with the annular space for discharging fluid from the body of fluid;

wherein the drilling system further comprises a pump having a fluid outlet in fluid communication with the body of fluid;

wherein the fluid outlet of the pump is in fluid communication with the body of fluid via said fluid discharge conduit; and wherein the fluid discharge conduit is provided with an injection nozzle in fluid communication with the fluid outlet of the pump, said nozzle being arranged to inject a stream of injection fluid into the fluid discharge conduit in a direction counter the direction of flow of drilling fluid through the discharge conduit.

2. The drilling system of claim 1, wherein the pressure control means comprises means for controlling the flow resistance in the fluid discharge conduit.

3. The drilling system of claim 1, wherein the fluid discharge conduit is provided with a controllable valve for controlling the flow resistance of fluid flowing through the fluid discharge conduit.

4. The drilling system of claim 1, wherein the pump is provided with pump control means for controlling the pump rate of the pump.

5. The drilling system of claim 3, wherein the pressure control means comprises a pump having a fluid outlet in fluid communication with the body of fluid; and wherein the fluid discharge conduit is provided with a branch connection to the fluid outlet of the pump, the branch connection being arranged between the annular space and the valve.

6. A drilling system for drilling a borehole into an earth formation, the drilling system comprising a drill string extending into the borehole whereby an annular space is formed between the drill string and the borehole wall, the annular space containing a body of fluid, the drill string including a longitudinal fluid passage having an outlet opening at the lower end part of the drill string;

pumping means for selectively pumping drilling fluid via said passage and outlet opening into the body of fluid, said pumping means in fluid communication with the passage; and a fluid discharge conduit in fluid communication with the annular space for discharging fluid from the body of fluid;

wherein the drilling system further comprises pressure control means for controlling the fluid pressure in the body of fluid, said pressure control means in fluid communication with the body of fluid; and wherein the pressure control means includes a non-return valve arranged to prevent flow of fluid from the body of fluid into the fluid passage of the drill string.

7. A drilling system for drilling a borehole into an earth formation, the drilling system comprising a drill string extending into the borehole whereby an annular space is formed between the drill string and the borehole wall, the annular space containing a body of fluid, the drill string including a longitudinal fluid passage having an outlet opening at the lower end part of the drill string;

pumping means for selectively pumping drilling fluid via said passage and outlet opening into the body of fluid, said pumping means in fluid communication with the passage; and a fluid discharge conduit in fluid communication with the annular space for discharging fluid from the body of fluid;

wherein the drilling system further comprises pressure control means for controlling the fluid pressure in the body of fluid, said pressure control means in fluid communication with the body of fluid; and wherein the drill string includes a lower section and an upper section, which sections are interconnected by releasable connector means, and wherein when the connector is released an open upper end of the lower drill string section is in fluid communication with a supply conduit for supplying drilling fluid to the body of fluid via the lower drill string section.

8. The drilling system of claim 7, wherein said supply conduit debouches into a fluid chamber having a lower opening through which the lower drill string section extends in a sealing manner and whereby the open upper end of the lower drill string section is arranged within the fluid chamber.

9. The drilling system of claim 8, wherein said fluid chamber is provided with an upper opening through which the upper drill string section extends in a sealing manner.

10. The drilling system of claim 8, wherein the fluid chamber includes a lower portion and an upper portion sealed from the lower portion by removable sealing means, and wherein when the connector is released the open upper end of the lower drill string section is arranged in the lower fluid chamber portion and the open lower end of the upper drill string section is arranged in the upper fluid chamber portion.

* * * * *